United States Patent [19]

Yamazaki et al.

[11] 4,133,491

[45] Jan. 9, 1979

[54] METHOD OF AND APPARATUS FOR WINDING UP TAPES ON REELS

[75] Inventors: Tuneo Yamazaki; Kaoru Shiino; Akira Yamaguchi; Toshihiro Kato, all of Odawara, Japan

[73] Assignee: Fuji Photo Film Co., Ltd., Minami-ashigara, Japan

[21] Appl. No.: 821,916

[22] Filed: Aug. 4, 1977

[30] Foreign Application Priority Data

Aug. 6, 1976 [JP] Japan ..... 51-94372

[51] Int. Cl.[2] ..... B65H 19/04

[52] U.S. Cl. ..... 242/56.9

[58] Field of Search ..... 242/56 R, 56.2, 56.3, 242/56.4, 56.5, 56.6, 56.7, 56.8, 56.9, 67.1 R, 67.2, 67.3 R

[56] References Cited

U.S. PATENT DOCUMENTS

| | | | |
|---|---|---|---|
| 344,187 | 6/1886 | Manning | 242/56.9 |
| 2,178,673 | 11/1939 | Serrurier | 242/56.9 |
| 2,755,029 | 7/1956 | Speed | 242/56.9 |
| 3,921,929 | 11/1975 | Jores | 242/56.9 |

*Primary Examiner*—Edward J. McCarthy
*Attorney, Agent, or Firm*—Fleit & Jacobson

[57] ABSTRACT

A number of reel groups each consisting of two or more reels are axially arranged side by side on reel support shafts. A number of tapes equal to the number of reel groups are wound simultaneously, one on a corresponding reel of each reel group. When the tapes are fully wound up on the reels of the reel groups, the reel groups are axially shifted on the shafts to change reels. The axial movement of the reel groups may be made by axially sliding the reels on the shaft or by axially shifting the reels and the shaft together.

6 Claims, 3 Drawing Figures

METHOD OF AND APPARATUS FOR WINDING UP TAPES ON REELS

BACKGROUND OF THE INVENTION

1. Field of the Invention

This invention relates to a tape wind-up method and apparatus, and more particularly to a method of and an apparatus for winding up a number of tapes simultaneously as in a web slitter. The tape wind-up method and apparatus in accordance with the present invention are particularly applicable to a web slitter wherein a wide web is slit into a number of tapes and the slit tapes are wound up on reels simultaneously.

2. Description of the Prior Art

In a web slitter in which a wide web is slit into a number of thin tapes by means of a slitter or a rotary cutter, the slit tapes are wound up on a number of wind-up reels simultaneously. When the wind up of the tapes is completed on a set of reels, the tapes are cut and the reels are replaced with to new ones. Changing of the reels involves removal of the wound-up reels from take-up shafts and loading of empty reels in their place. Since the change of reels takes a long time and considerable labor, the productivity of the tape wind-up system is markedly lowered by the reel change operation.

SUMMARY OF THE INVENTION

It is an object of the present invention to provide a tape wind-up method in which a number of tapes are wound up simultaneously on a set of tape wind-up reels and the tape wind-up reels are changed from one set to another smoothly almost without stopping the feed of the tapes.

Another object of the present invention is to provide a tape wind-up apparatus in which a number of tapes are wound up simultaneously on a set of tape wind-up reels and the tape wind-up reels are changed from one set to another very quickly.

The above objects are accomplished by winding up a number of tapes simultaneously, each tape being wound on a corresponding reel of a number of reel groups each consisting of two or more reels axially arranged side by side on reel support shafts, and changing the reels when the tapes are fully wound up on the reels by shifting all reel groups axially. The axial movement of the reel groups may be made by sliding the reels on the shaft thereof or by axially shifting the reels and the shaft together.

Since the reels are changed only by shifting the reel groups, there is no need to remove the first set of reels on which the tapes have been fully wound up from the reel support shaft. The reels are removed from the shaft only when all the reels are filled with tape. Therefore, the tapes are wound up on the reels efficiently and with high productivity.

PREFERRED EMBODIMENTS OF THE INVENTION

Figure 1:
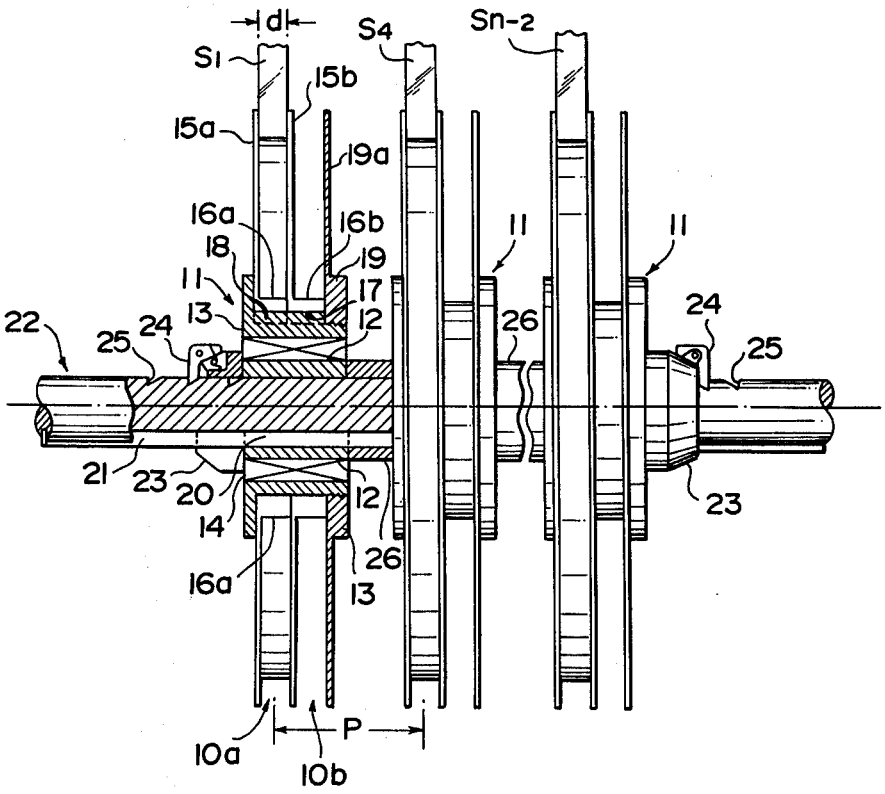
FIG. 1 is a partially sectional fragmentary front view of a reel group employed in one embodiment of this invention.
Figure 2:
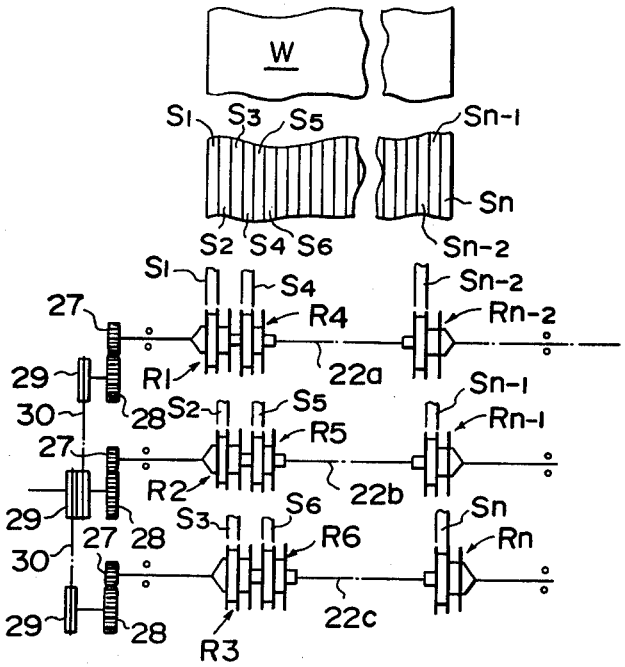
FIG. 2 is a schematic view showing the whole system of the tape wind-up apparatus in accordance with an embodiment of this invention.
Figure 3:
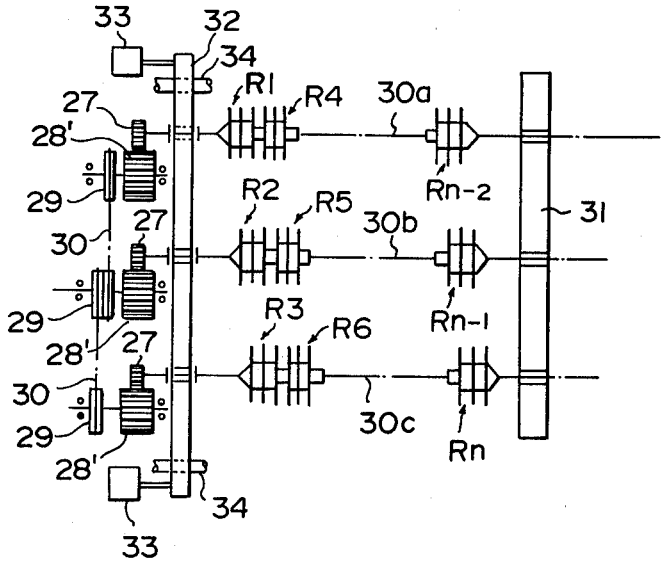
FIG. 3 is a schematic view showing the whole system of the tape wind-up method in accordance with another embodiment of this invention.

Now preferred embodiments of the present invention will be described in detail with reference to FIGS. 1 to 3, wherein FIGS. 1 and 2 show a first embodiment and FIG. 3 shows a second embodiment.

Referring to FIG. 1, two one flange type reels 10*a* and 10*b* are mounted on a reel holder 11 composed of an inner ring 12, an outer ring 13 and an annular bearing 14 interposed therebetween. The reel 10*a* (10*b*) has only one flange 15*a* (15*b*) and a core 16*a* (16*b*). The internal periphery of the core 16*a* (16*b*) is provided with an engaging groove 17 to be engaged with an axially extending rib 18 on the outer ring 13 so that the reels 10*a* and 10*b* are rotated by the reel holder 11. The reel holder 11 is further provided with a ring 19 screw engaged with the outer ring 13. The ring 19 has a large flange 19*a* extending in parallel to the flanges 15*a* and 15*b* of the reels 10*a* and 10*b*. The inner ring 12 has on its inner periphery a groove 20 extending axially to be engaged with a key 21 of a shaft 22 so that the reel holder 11 may be rotated by the shaft 22.

A conical stopper 23 is slidably mounted on the shaft 22 to hold the reel holder 11 at a desired position by use of a claw 24 mounted thereon and serrations 25 on the shaft 22. A number of reel holders 11 are provided on shaft 22 with a spacer ring 26 inserted between adjacent ones thereof to maintain a predetermined space therebetween.

Referring to FIG. 2, a number of reel groups R1 to Rn are mounted on three shafts 22*a*, 22*b* and 22*c*. Each reel group consists of two reels 10*a* and 10*b* arranged axially side by side on the shaft 22. The three shafts 22*a*, 22*b* and 22*c* are in parallel to each other and are rotated simultaneously in the same direction by means of gears 27 mounted on the shafts, gears 28 meshed with said gears 27, pulleys 29 fixed to the latter gears 28 and belts 30 tensioned around the pulleys 29. Said number of reel groups R1 to Rn are mounted on the three shafts 22*a*, 22*b* and 22*c* in the following manner. The first reel group R1 is mounted on the first shaft 22*a*, the second reel group R2 is mounted on the second shaft 22*b*, the third reel group R3 is mounted on the third shaft 22*c*, the fourth reel group R4 is mounted on the first shaft 22*a* adjacent to said first reel group R1, the fifth reel group R5 is mounted on the second shaft 22*b* adjacent to said second reel group R2, the sixth reel group R6 is mounted on the third shaft 22*c* adjacent to said third reel group and so forth. Thus, n-number of reel groups R1 to Rn are mounted on the three shafts 22*a* to 22*c* in order. The number "n" corresponds to the number of the slit tapes S1 to Sn slit from a wide web W. The position of the second reel group R2 is displaced along shaft 22*b* from the position of the first reel group R1 on shaft 22*a* by the width of the tape S1, that is the width designated by "d" in FIG. 1. The third reel group R3 is displaced from the second reel group R2 by the same width d. Then, the fourth reel group R4 is displaced from the third reel group R3 by the width d. Thus, the fourth reel group R4 mounted on the first shaft 22*a* adjacent to the first reel group R1 is displaced from the first reel group R1 by a distance of 3d, i.e. three times d, which is represented by "P" in FIG. 1.

In the embodiment shown in FIGS. 1 and 2, each reel group consists of two reels 10*a* and 10*b*, and the reel groups are mounted on three shafts 22*a* to 22*c*. It should be noted, however, that the number of the reels constituting the reel group need not be two but may be three or more, and the number of shafts on which the reel groups are mounted need not be three but may be four or more.

In operation, the n-number of tapes S1 to Sn are wound up on the left side reels 10*a* of the n-number reel groups R1 to Rn in FIG. 2. Then, when the left side reels 10*a* are filled with the tapes, namely when the wind up operation of the tapes on the left side reels 10*a* is completed, the tapes are cut and the leading ends of the tapes from the wide web W are wound on the respective right side reels 10*b*. At this moment, the reel groups R1 to Rn are all slid to the left in FIG. 2 by the distance of the width d of the tapes. The left side reels 10*a* are not removed from the shafts 22*a* to 22*c* at this stage. After the tapes S1 to Sn are completely wound up on the right side reels 10*b*, both the reels 10*a* and 10*b* are removed from the shafts 22*a* to 22*c*. Since there is no need to remove the reels every time the tapes are wound up, the time for changing reels is saved and accordingly the efficiency of the tape wind up process is enhanced.

In the above described embodiment, the reel groups are slid on the shafts when the winding of tape is changed from the left side reels 10*a* to the right side reels 10*b* by releasing the claws 24 from the serrations 25 on the shaft 22. However, it is also possible to axially move the reel groups by shifting the reel groups R1 to Rn together with the shafts 22*a* to 22*c*. Such an embodiment is shown in FIG. 3.

Referring to FIG. 3, reel groups R1 to Rn are irremovably mounted on three shafts 30*a*, 30*b* and 30*c*. The reel groups R1 to Rn are equivalent to those shown in the above described embodiment. The three shafts 30*a* to 30*c* are slidably supported by an end plate 31 at one end thereof. The other ends of the three shafts 30*a* to 30*c* are engaged with a slidable side frame 32 which is axially movable back and forth by a pair of actuators 33 along a pair of guide rods 34. The end of the shafts 30*a* to 30*c* are provided with a drive means consisting of gears 27 and 28', pulleys 29 and belts 30 like the first embodiment shown in FIG. 2. The gears 28' have a large thickness so that the gears 27 are able to slide thereon in the axial direction when the shafts 22*a* to 22*c* are slid back and forth. In this embodiment, when the tapes S1 to Sn have been fully wound up on the left side reels of the respective reel groups R1 to Rn, the three shafts 30*a* to 30*c* are slid to the left by a distance equal to the width d of the tapes together with the reel groups R1 to Rn mounted thereon. Then, when the tapes have been fully wound up on the right side reels of the respective reel groups, the reels are removed from the shafts.

In the above described embodiments shown in FIGS. 1 to 3, the reel group consists of two reels. As mentioned hereinbefore, the number of the reels in each reel groups may be more than two. When five reels are used to constitute one reel group, for instance, six shafts are used and the second reel group on the first shaft is spaced from the first reel group on the first shaft by the distance equal to the width of the tape. The second reel group on the first shaft is the seventh reel group to wind up the seventh tape. Thus, the first, seventh, thirteenth and nineteenth reel groups are mounted on the first shaft. In such a system using reel groups consisting of six reels, the reels need not be removed from the shafts until the six reels have all become full of tape. When all the six reels have become full of the tapes, the reels are all removed from the shafts and replaced with new reels.

We claim:

1. A method of winding up a number of tapes on a number of reels simultaneously comprising preparing a number of reel groups each consisting of a plurality of reels arranged in side by side relation, the number of said reel groups being equal to the number of tapes to be wound up simultaneously, mounting said reel groups on a plurality of shafts extending in parallel to each other in such a manner that said tapes may be simultaneously wound up on corresponding reels of said reel groups, winding up said tapes simultaneously on first reels of said reel groups, cutting the tapes when the tapes are fully wound up on said first reels, axially shifting said reel groups on shafts up to a position where the second reels of the reel groups come to the positions formerly occupied by the first reels, and winding up the tapes simultaneously on said second reels of the reel groups.

2. An apparatus for winding up a number of tapes on a number of reels simultaneously comprising a number of reel groups each consisting of a plurality of reels arranged in side by side relation, the number of said reel groups being equal to the number of tapes to be wound up simultaneously, a plurality of shafts on which said reel groups are mounted at equal intervals extending in parallel to each other, said reel groups being mounted on said shafts in such a manner that said tapes may be simultaneously wound up on corresponding reels of said reel groups, driving means connected with said shafts for rotating said shafts simultaneously in the same direction, and means for shifting said reel groups on said shafts up to a position where second reels of the reel groups come to the positions formerly occupied by the first reels.

3. An apparatus for winding up a number of tapes on a number of reels simultaneously as defined in claim 1 wherein said means for shifting said reel groups comprises means for allowing axial slide of said reel groups along said shafts, and means for determining the position of the reel groups on the shafts.

4. An apparatus for winding up a number of tapes on a number of reels simultaneously as defined in claim 1 wherein said means for shifting said reel groups comprises means for axially moving said shafts together with said reel groups mounted thereon.

5. An apparatus for winding up a number of tapes on a number of reels simultaneously as defined in claim 1 wherein the number of said reels of each reel group is two and the number of said shafts is three, and the first reel of one reel group on one shaft is spaced apart from the first reel of another reel group on the same shaft by a distance equal to three times the width of the tape wound up on the reels.

6. An apparatus for winding up a number of tapes on a number of reels simultaneously as defined in claim 5 wherein the first reel of a reel group mounted on a second shaft is displaced from the first reel of a reel group mounted on a first shaft by the distance equal to the width of the tape wound up on the reels.

* * * * *